United States Patent [19]

Ito

[11] Patent Number: 4,702,589

[45] Date of Patent: Oct. 27, 1987

[54] COPYING MACHINE THAT COPIES HALVES OF A DOCUMENT ON DIFFERENT RECORDING MEDIUM SURFACES

[75] Inventor: Masazumi Ito, Toyohashi, Japan

[73] Assignee: Minolta Camera Kabushiki Kaisha, Osaka, Japan

[21] Appl. No.: 881,250

[22] Filed: Jul. 2, 1986

[30] Foreign Application Priority Data

Jul. 4, 1985 [JP] Japan ..... 60-148074

[51] Int. Cl.[4] ..... G03G 15/00

[52] U.S. Cl. ..... 355/14 SH; 355/24; 355/3 SH; 355/7

[58] Field of Search ..... 355/14 SH, 3 SH, 7, 355/24, 23, 26, 8, 11, 66, 55, 57

[56] References Cited

U.S. PATENT DOCUMENTS 3,645,615 2/1972 Spear, Jr. .
3,869,202 3/1975 Tabata et al. .
4,017,173 4/1977 Komori .
4,076,407 2/1978 Place, Jr. .
4,436,409 3/1984 Queener ..... 355/7 X
4,455,081 6/1984 Yoshimura et al. ..... 355/14 SH
4,511,246 4/1985 Nishiyama ..... 355/14 SH
4,568,181 2/1986 Nishiyama ..... 355/14 SH
4,585,332 4/1986 Shenoy ..... 355/14 SH
4,597,663 7/1986 Yoshiura et al. ..... 355/55 X

*Primary Examiner*—R. L. Moses
*Attorney, Agent, or Firm*—Burns, Doane, Swecker & Mathis

[57] ABSTRACT

The present invention relates to a copying machine capable of copying halves of a document onto different copying paper surfaces. When the size of the document is in a predetermined relation with the size of a previously copied document, for example double size of the previously copied document, the copying machine copies halves of the original document respectively on different copy sheets.

26 Claims, 25 Drawing Figures

| decimal code | binary code | | | paper size |
|---|---|---|---|---|
| 0 | 0 | 0 | 0 | |
| 1 | 0 | 0 | 1 | B5 lengthwise |
| 2 | 0 | 1 | 0 | A4 lengthwise |
| 3 | 0 | 1 | 1 | B4 lengthwise |
| 4 | 1 | 0 | 0 | A3 lengthwise |
| 5 | 1 | 0 | 1 | B5 widthwise |
| 6 | 1 | 1 | 0 | A4 widthwise |
| 7 | 1 | 1 | 1 | cassette empty |

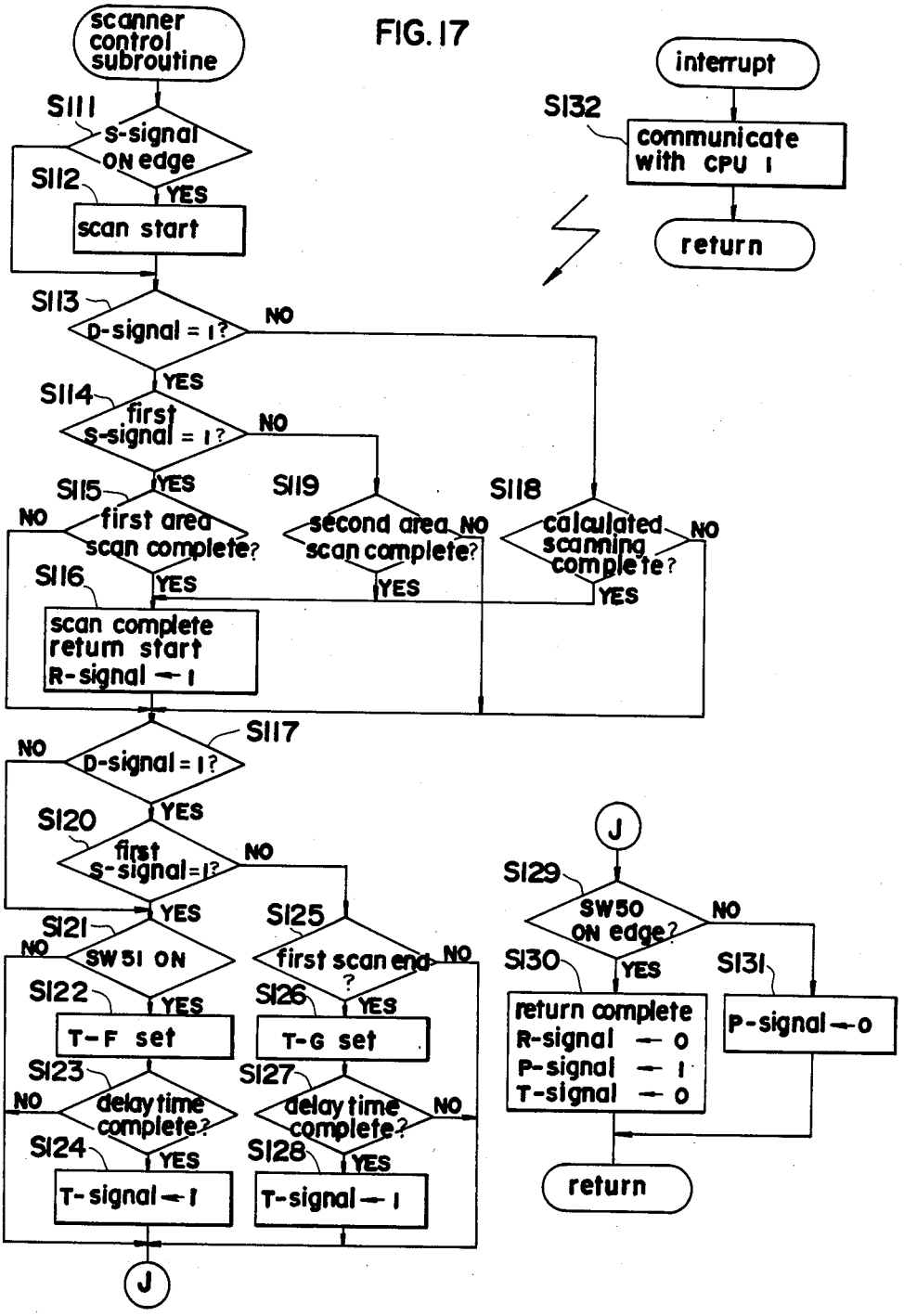
FIG. 17
scanner control subroutine
S111
S-signal ON edge
YES
S112
scan start
S113
D-signal = 1?
NO
YES
S114
first S-signal = 1?
NO
YES
S115
first area scan complete?
NO
YES
S116
scan complete return start R-signal ← 1
S119
second area scan complete?
NO
YES
S118
calculated scanning complete?
NO
YES
S117
D-signal = 1?
NO
YES
S120
first S-signal = 1?
NO
YES
S121
SW51 ON
NO
YES
S122
T-F set
S123
delay time complete?
NO
YES
S124
T-signal ← 1
S125
first scan end?
NO
YES
S126
T-G set
S127
delay time complete?
NO
YES
S128
T-signal ← 1
J
interrupt
S132
communicate with CPU 1
return
J
S129
SW50 ON edge?
NO
YES
S130
return complete
R-signal ← 0
P-signal ← 1
T-signal ← 0
S131
P-signal ← 0
return

COPYING MACHINE THAT COPIES HALVES OF A DOCUMENT ON DIFFERENT RECORDING MEDIUM SURFACES

BACKGROUND OF THE INVENTION

1. Field of the Invention

The present invention relates to a copying machine capable of copying halves of a document on different recording medium surfaces. More particularly, the present invention relates to a copying machine which automatically performs divisional copying when the size of a document to be copied is in a predetermined relation with the size of a document previously copied.

2. Description of the Prior Art

The automatic duplex copying machine adapted to perform copying on both sides of a copying paper is known and many versions of the machine have been proposed in U.S. Pat. Nos. 3,645,615 and 4,076,407, for instance. With a copying machine of this type, there is the following disadvantage. Suppose that copying paper of A4 size has been designated and that the size of the document to be copied on the face side of the copying paper is A4 and that of the document to be copied on the reverse side is A3. Then, only one half of the A3-sized document can be copied.

There have also been proposed copying machines each adapted to divide the document setting area into two regions and copy the documents positioned in the respective regions on different sheets of copying paper or on both sides of the same copying paper. Such machines are described in U.S. Pat. Nos. 3,869,202 and 4,017,173, among others. However, none of such copying machines provide a solution to the above-mentioned problem that occurs when the document size for face-side copying is different from that for reverse-side copying in a double side copying mode.

SUMMARY OF THE INVENTION

It is a primary object of the present invention to provide a copying machine which is capable of copying documents without defection of the document image even when a document to be copied is larger in size than a document previously copied.

It is another object of the present invention to provide a copying machine which performs divisional copying when the size of a document copied on one side of copying paper and that of a document to be copied on the reverse side are in predetermined mutual relation so as to copy the latter document in divided formats without involving an image defection.

It is still another object of the present invention to provide a copying machine which performs divisional copying when the size of a document previously copied and that of a document to be copied next are in predetermined mutual relation so as to divide the image of the latter document and copy each of the divided images without involving an image defection.

In order to accomplish the above objects, the copying machine according to the present invention comprises means for memorizing the size of the document just copied, means for designating the size of the document to be copied next, and control means which, when the size of a document previously copied and that of a document to be copied next are in predetermined mutual relation, executes divisional copying for the latter document.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

In the accompanying drawings,

FIG. 8 to FIG. 20 are flow charts illustrating the sequences of control by the control circuit.

The present invention will hereinafter be described in detail by way of a preferred embodiment of the present invention which is illustrated in the accompanying drawings.

Figure 1:
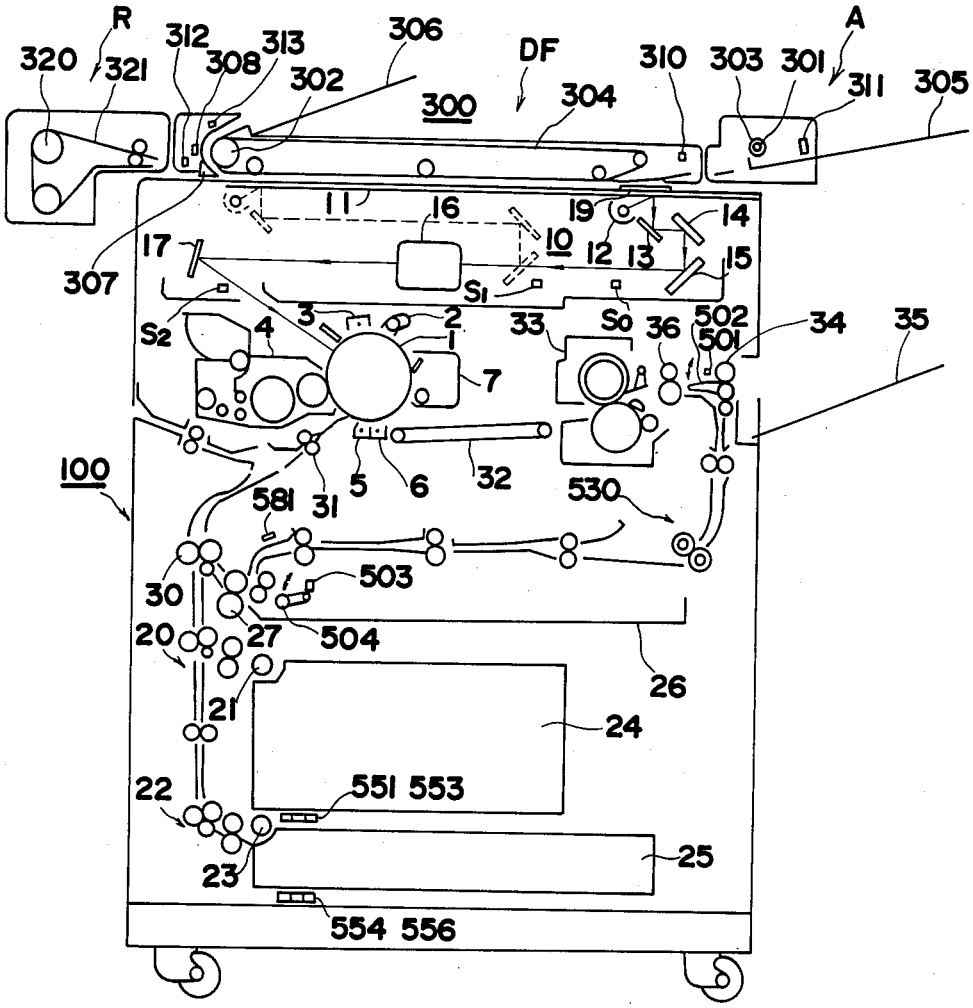
FIG. 1 is front elevation view showing an example of a copying machine used in the present invention.

Referring, first, to FIG. 1, the construction and operation of a copying machine which is operable on an operation mode synchronized with an automatic document transport system will be schematically described.

In an approximate center of a copying machine body (100) there is provided a photoreceptor drum (1) as supported rotatably in a counterclockwise direction in the figure. Further, disposed in a sequential arrangement surrounding said photoreceptor drum are an eraser lamp (2), an electrostatic charger (3), a developing unit (4), a transfer charger (5), a separation charger (6), and a cleaning unit (7). The photoreceptor drum (1) carries a photoreceptor layer on its surface and the photoreceptor layer is sensitized and charged as the drum passes said eraser lamp (2) and electrostatic charger (3) and forms an electrostatic latent image on its surface under imagewise exposure by a scanning optical system (10).

The scanning optical system (10) is disposed under a glass document table (11) for document image scanning and comprises an exposure lamp (12), movable mirrors (13), (14) and (15), and a projection lens (16). The aforesaid exposure lamp (12) and movable mirror (13) are driven by a motor not shown so that they travel to the left at a speed equal to (v/n) wherein (n) is the copy magnification factor and (v) (which is constant irrespective of the magnification factor) is the peripheral speed of the photoreceptor drum (1). The movable mirrors (14), (15) are also driven in the like manner so that they will travel to the left in the figure at a rate equal to (v/2n).

Copying paper is fed to a copying section from a first paper supply tray (24) or a second paper supply tray (25) by an automatic paper supply mechanism (20) or (22). The copying paper withdrawn by an upper paper supply roll (21) or a lower paper supply roll (23) is fed through an intermediate roll (30) and as its leading edge is sensed by a paper detection sensor, the paper is stopped once at a timing roll (31). And as the scanning optical system (10) turns on a resist switch not shown, the copying paper is sent into the copying section in timed relation with the image formed on the photoreceptor drum (1), receives a tonor image from the transfer charger (5), is separated from the surface of the photoreceptor drum (1) by the separation charger, transported via a conveyor belt (32) to a fixing unit (33), where it has its image fixed by a heat roll, and is finally discharged via a discharge roll (34) onto a paper discharge tray (35). After the image transfer, the photoreceptor drum (1) is stripped of the residual tonor and static charge on the surface by a cleaning unit (7), etc. and waits for the next copying cycle.

In contrast to the above simplex copying process, a duplex copy process is performed as follows. When the copying paper has travelled from the fixing unit (33) to a guide roll (36), its leading edge is deflected downward by the action of a discharge switch lever (502) which is actuated by a solenoid (501), passes through a paper pathway (530) formed in the manner of the inverted letter S, and is received in a paper re-supply tray (26). The passage of the copying paper travelling through the paper pathway (530) and entering the paper re-supply tray is detected by a paper sensor (581).

Figure 2A:
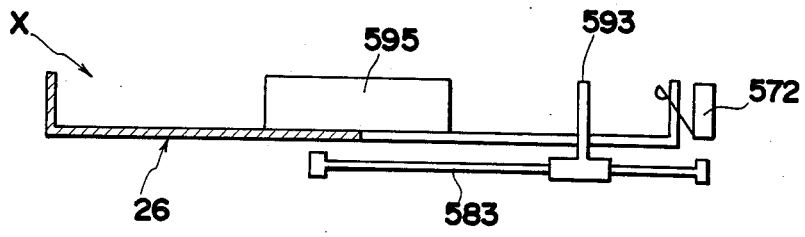
FIG. 2(*a*), (*b*) are diagrammatic views showing the relation between the paper resupply tray and various sensors.
Figure 2B:
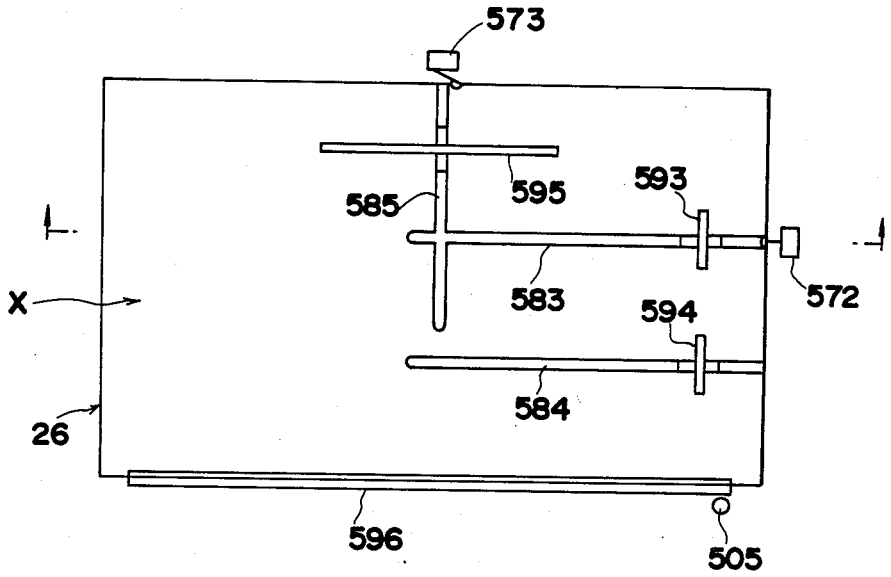
Figures 3, 5:
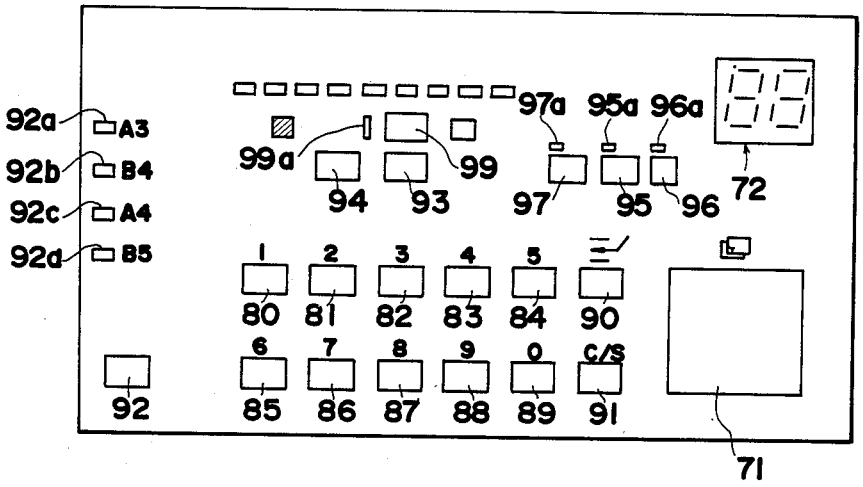
FIG. 3 is a table showing the correspondence between paper size and paper code.
FIG. 5 is a plan view showing the operation panel.

As shown in FIG. 2, the paper re-supply tray (26) has an elongated rectangular configuraiton extending in the direction of entry of copying paper and the entering copying paper is aligned by dividing plates (593), (594) and (595) according to its size. A pair of dividing plates (593) and (594) regulate the lengthwise orientation of the copying paper, while the dividing plate (595) regulates the lateral orientation of the paper. As a copying paper is selected and the duplex copying mode is selected, said dividing plates are automatically shifted according to the selected paper size and stopped in positions suitable for the paper size. Thus, upon selection of the duplex copying mode, the dividing plates (593) and (594) move to the right in the figure along guide rods (583), (584) fixed under the tray, and as the dividing plate (593) turns on the limit switch (572), it is shifted in a reverse direction to a position corresponding to a predetermined paper length and stopped. Similarly, the dividing plate (595) moves in the upward direction in FIG. 2 (*b*) along a stationary guide rod (585) and as it turns on a limit switch (573), it is shifted in a reverse direction to a position corresponding to a predetermined paper width and is stopped there. An actuating plate (596) disposed along one side of the paper re-supply tray (26) is rocked by a solenoid (505) as the copying paper enters into the tray (26) so as to align the width direction of the copying paper. The paper size which serves as the basis of control of the movement of said dividing plates (593) to (595) is previously coded and as shown in FIG. 3, has been assigned with a 3-bit binary code. In connection with paper size, 3-bit paper size sensors (551) to (553) and (554) to (556) are disposed under the paper supply trays (24) and (25), respectively, so that as a predetermined paper supply tray is loaded, the paper size code is automatically set in this copying machine.

When a copying process is to be applied to the reverse side of a copying paper stored in the paper re-supply tray (26) with its image-formed surface up, the paper re-supply roll (504) is biased downward by a solenoid (503) adapted to move the roll (504) up and down and a roller clutch is actuated to rotate the roll (504) to thereby feed out the copying paper toward the roll pair (27). The copying paper so fed out travels from the roll pair (27) to the intermediate roll (30) to the timing roll (31) and is sent into the copying section where the above-mentioned copying process is executed. The copying paper carrying an image on either side passes through the conveyor belt (32), fixation unit (33) and guide roll (36), and after passing above the discharge switch lever (502), is discharged into the discharge paper tray (35).

Figure 4:
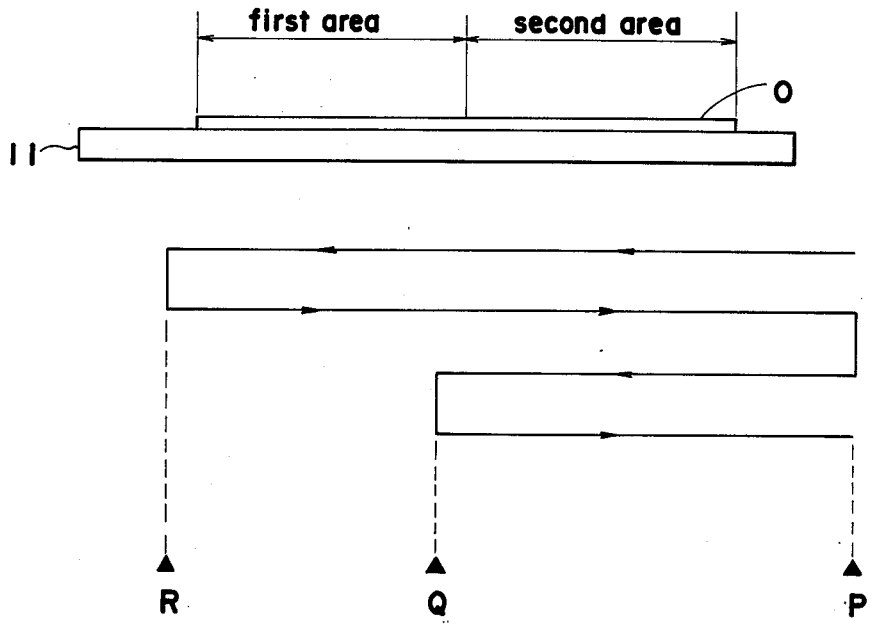
FIG. 4 is a diagrammatic view showing the motion of the scanning system on a divisional scanning mode.

The copying machine (100) is further capable of performing divisional copying such that the scanning region over the glass document table (11) is divided in the scanning direction into a first region and a second region, which are assigned to different sheets of copying paper or both sides of the same copying paper. To be specific, as shown in FIG. 4, the scanning optical system 10 first scans from the home position P to a first return position corresponding to the trailing edge of a document O for a first regional copying and returns to the home position P. Then, the scanning optical system 10 scans to a second return position corresponding to the center of the document O for a second regional copying and returns to the home position P again. Through the above series of scanning, the first and second regions of the document O can be copied on independent sheets of copying paper or on the face and reverse sides of a sheet of copying paper, respectively. Whether the divided images in the two regions are to be copied on different sheets or on both sides of a single sheet of copying paper depends on whether the copying mode of the copying machine is the simplex copying mode or the duplex copying mode. Moreover, as will be described hereinafter, the divisional copying mode is automatically selected when the document size for reverse side copying on the duplex copying mode is twice the document size for face side copying. At this time, the first region of the document is copied on the reverse side of the copying paper for which face-side copying has already been performed and the remaining second region is copied on the face side of the next copying paper.

On the other hand, disposed on top of the copying machine (100) is an automatic document feeding unit (300) which comprises a document feeding device DF adapted to feed the document to an exposure position, an automatic document supply mechanism A adapted to automatically supply the document to DF, and a document reversing mechanism (hereinafter referred to sometimes as R) which is disposed on the opposite side of DF with respect to A and adapted to reverse the document discharged from DF. As it is detected that ADF (300) has been electrically connected to the body of the copying machine (100) and has been set in a predetermined position, control of ADF (300) and that of the copying machine (100) are mutually associated when the operation mode of the copying machine is switched to the ADF mode. The ADF mode is set as a print key (71) (See FIG. 5) on the copying machine (100) is operated. The ADF (300) is actuated while the copying machine (100) keeps standby. Thus, a roll motor (301) and a conveyor belt motor (302) are started to drive a document feed roller (303) and a document transport belt (304) to thereby supply the document placed on a document tray (305) along the top surface of the glass document table (11) and is stopped at a predetermined position at a predetermined time after the leading edge thereof has passed a supply sensor (310) which detects the supply of the document, and at the same time, a start signal is transmitted from ADF (300) to the copying machine (100), whereby the above-described copying operation is initiated. Upon completion of the final scanning movement for the particular document, an action signal is transmitted from the copying machine (100) to ADF (300), whereupon the ADF (300) discharges the document onto a discharge tray (306). If the next document is present on the document tray (305) at this moment, the transport of the next document to said predetermined position is also carried out simultaneously with said discharge. A document sensor (311) senses whether a document is present on the document tray (305).

While the basic ADF mode has been described above, as a duplexed document is set on the document tray (305) and the duplex copying mode to be described hereinafter is selected, the document reversing mechanism R is also simultaneously actuated. Thus, as the document on the glass document table (11) is transported by the conveyor belt (304) toward the R unit, a switch lever (307) for selecting the discharge of the document or the feeding thereof into the R unit is driven by a solenoid (308). The document is fed into the R unit and is reversed by a belt (321) which is driven by a motor (320) for driving the document reversing unit. The document is then fed to DF. A paper sensor (312) senses that the document has been fed into the R unit. A sensor (313) senses that the document has been discharged onto the document discharge tray (306).

FIG. 5 shows the operation panel of the copying machine (100). The reference numeral (71) indicates a print key, (72) a number-of-copy display, (80)-(89) a ten-key set for setting the number of copies, (90) an interrupt key, (91) a clear stop key, (93) and (94) up and down keys, respectively, for setting the image density, (92) a paper size select key, and (92*a*) to (92*d*) display segments for selected paper size.

Disposed between the up and down keys (93, 94) and the number-of-copy display (72) are a key (95) for selecting the double-side copying mode, that is the mode of copying on both sides of copying paper, a select key (97) for selecting the duplex copying mode for actuation of said R unit in the case of a duplexed document, and a select key (96) for selecting the divisional copying mode for dividing a document into halves and copying the halves on different surfaces of copying paper. When the duplex copying mode select key (95) is pressed, the display segment (95*a*) illuminates to indicate that this mode has been selected. Similarly, when the duplex document mode select key (97) is pressed, the display segment (97*a*) illuminates, indicating that this mode is executed. The display segment (96*a*) illuminates when the divisional copying mode select key (96) is depressed.

A key (99) is available for selecting an automatic exposure mode which adjusts the image density automatically without a manual setting of image density with the up and down keys (93), (94). A display segment (99*a*) indicates that the automatic exposure mode has been selected.

Figure 6:
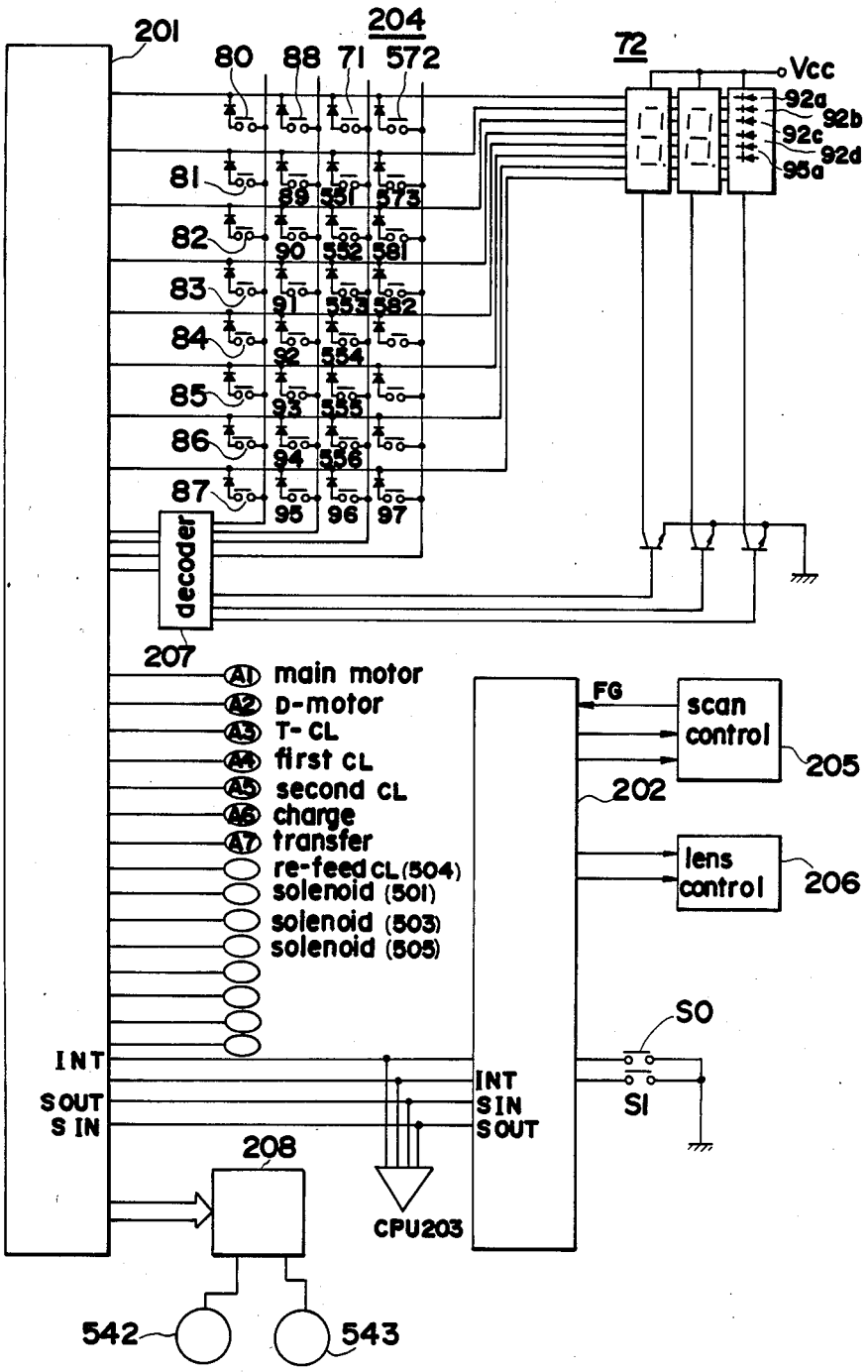
FIG. 6 shows the construction of the copying machine control unit.

FIG. 6 shows the construction of the copying machine control unit. The reference numeral (201) indicates a first CPU which controls the operation of the copying machine body, (202) is a second CPU which controls the scanning optical system 10; (204) is a switch matrix; (205) is a driving circuit for a DC motor M3 for document scanning, (206) is a driving circuit for a stepping motor M4 for variable multiplication; and (207) is a decoder. Output terminals A1 to A7 are respectively connected to transistors (not shown) for drive switching of the main motor, development motor, timing roller clutch, upper paper supply clutch, lower paper supply clutch, charger and transfer charger of the copying machine.

The reference numeral 208 indicates an output port expansion IC for stepping motors; (542) is a stepping motor for shifting the dividing plates (593) and (594); and (543) is a stepping motor for shifting the dividing plate (595).

Figure 7:
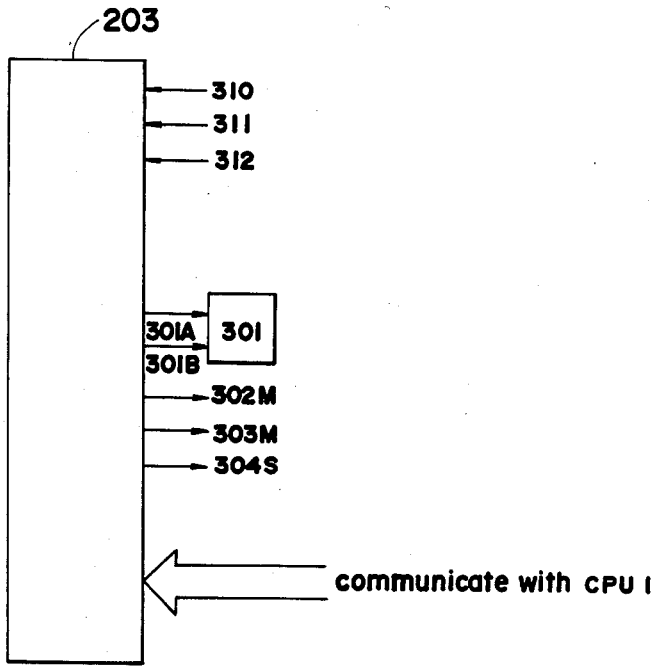
FIG. 7 is a block diagram showing an example of a control circuit.

FIG. 7 shows a third CPU which controls a motor 302 M for driving the document supply roll, a motor 303 M for driving the document reversing unit, a solenoid 307 S for driving the switching lever, and ADF to which various sensors 310 to 312 are connected.

The reference symbols (301A) and (301B) indicate control signals for normal and reverse rotations, respectively, of a motor (301) for the document transport belt (320).

Figure 8:
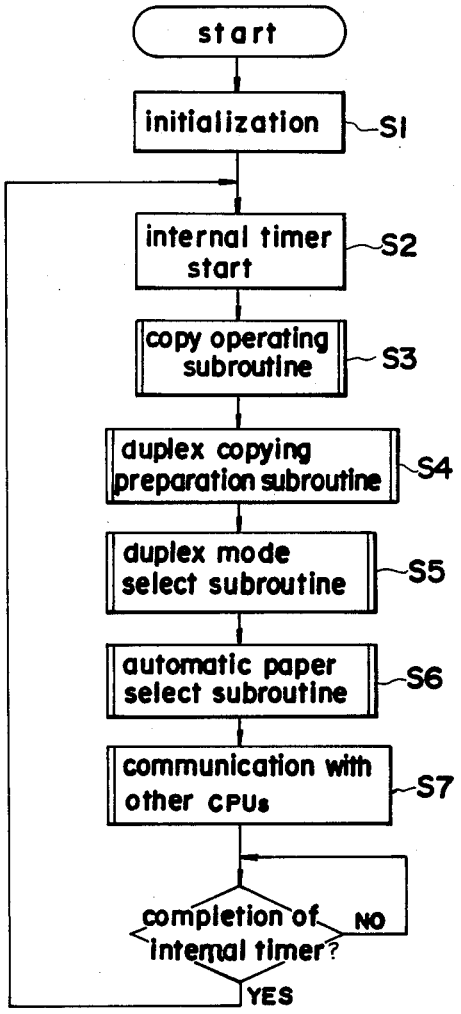
Figure 9A:
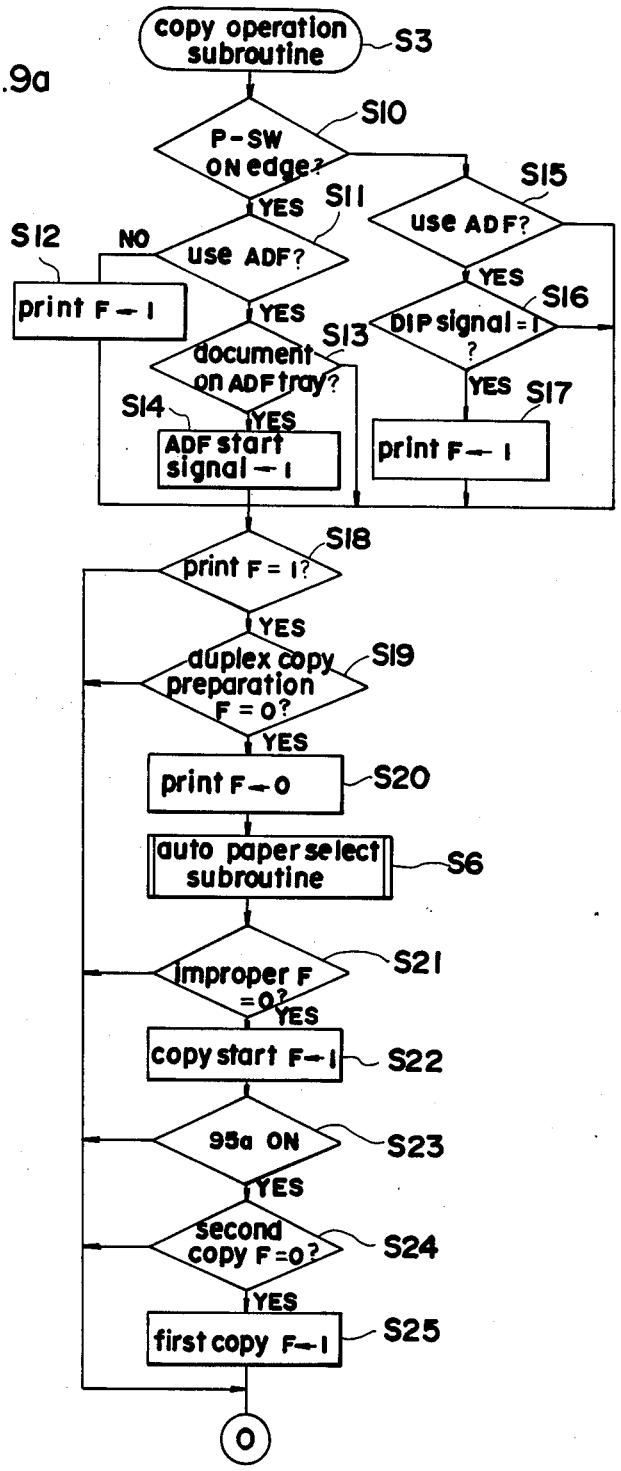
Figure 9B:
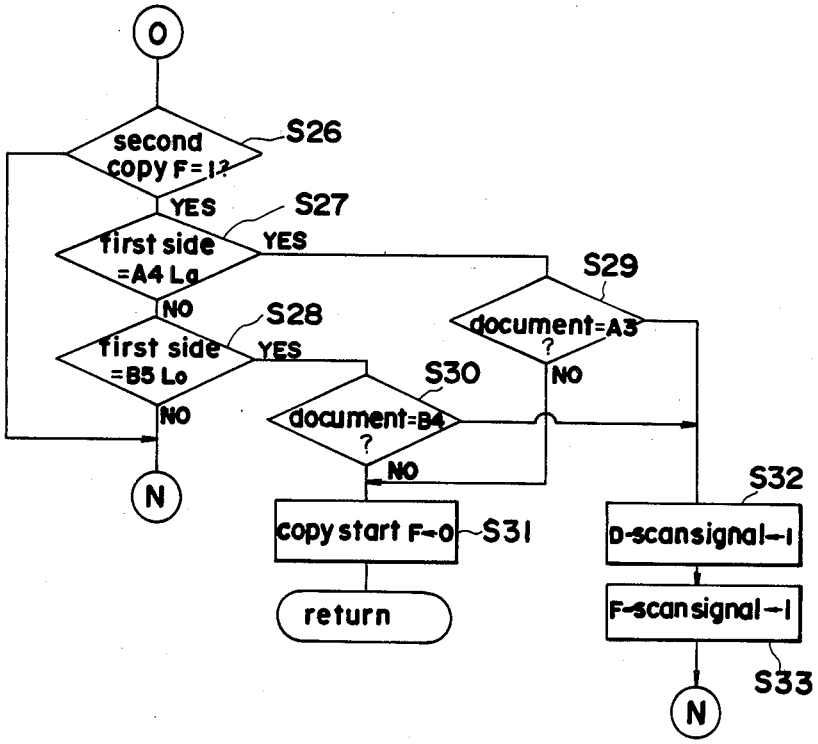
Figure 9C:
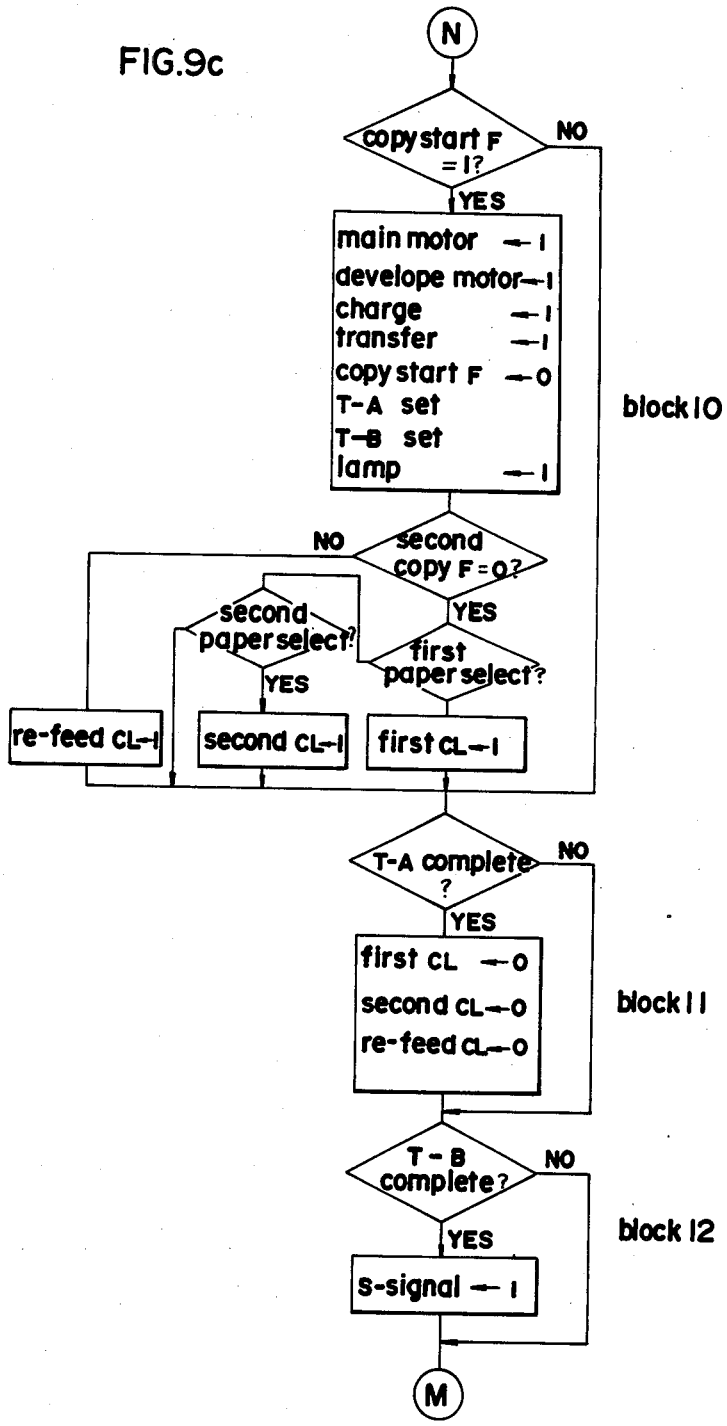
Figure 9D:
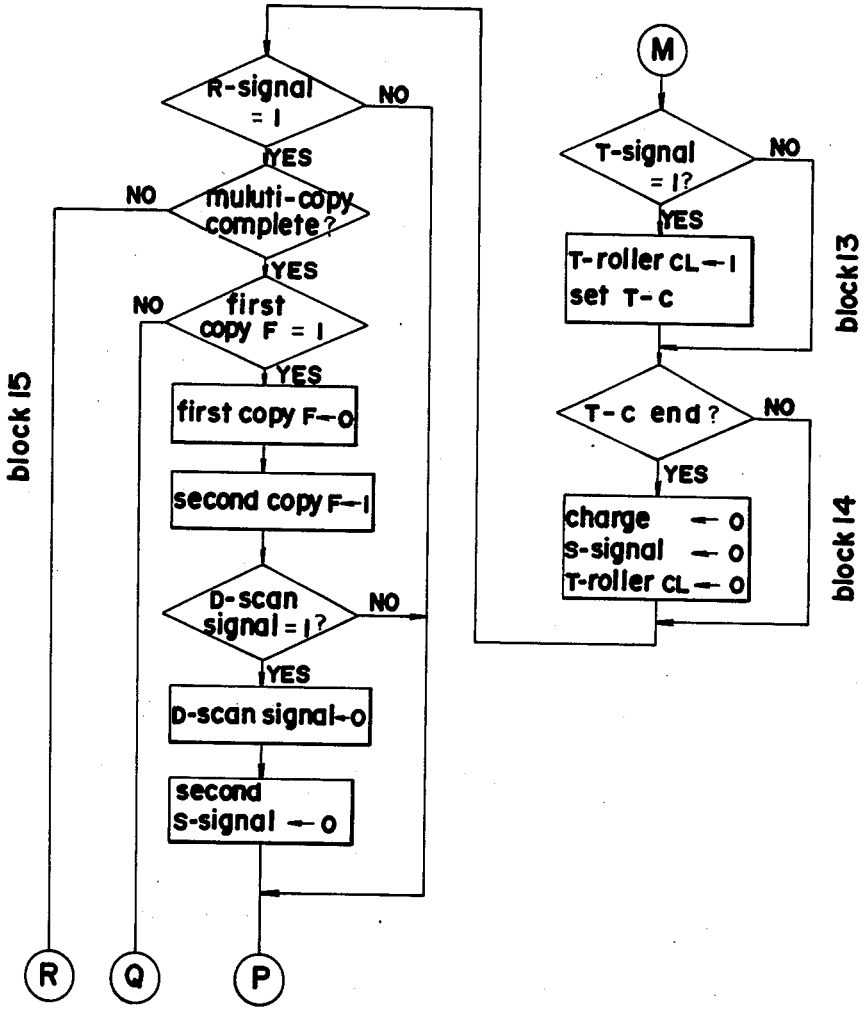
Figure 9E:
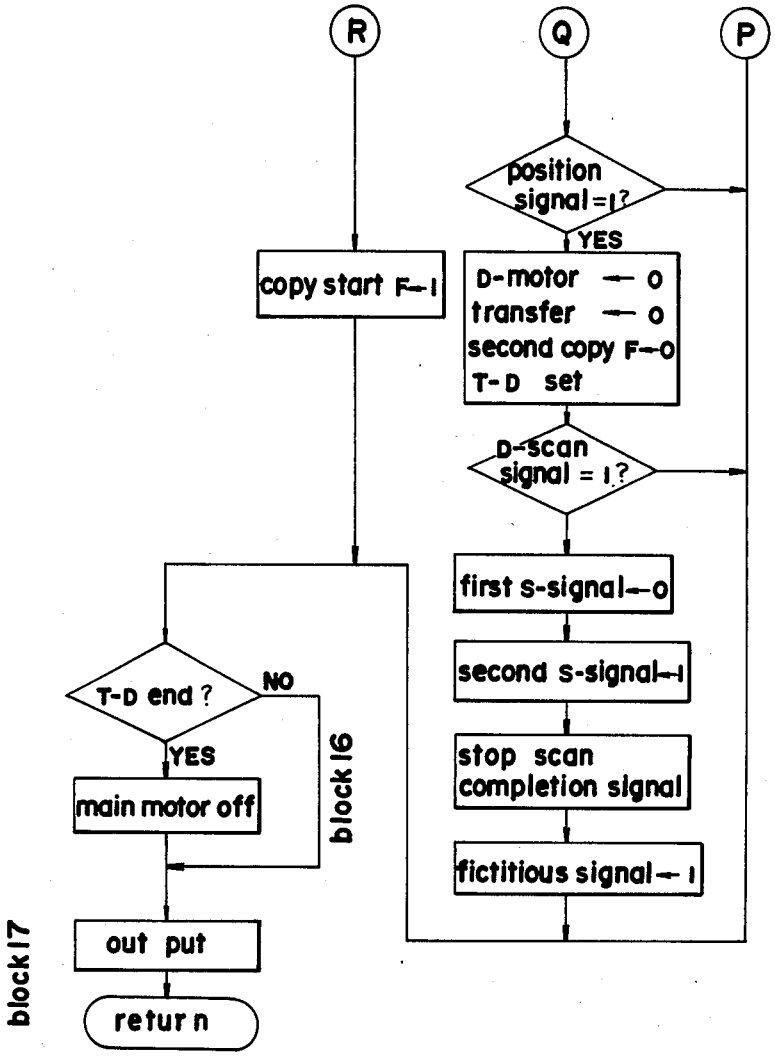

FIG. 8 is a schematic flow chart of the first CPU 201. As the first CPU is reset to start the program, RAM is cleared, various register settings in the first CPU 201 are initialized, and the machine is set in the initial mode at Step S1.

Then, at Step S2, an internal timer built into the first CPU 201 and preset to a given value by an initial setting is started.

Then, at Steps S3 to S7, the respective subroutines shown in the flow chart are sequentically called and all the subroutines are processed and the completion of the internal timer is awaited to complete one routine. Using the length of time of this one routine, the various timer values emerging in the subroutines are counted. (As to the various timer values, the completion of the respective timer is judged from how many times this one routine was counted).

In addition, the first CPU 201 calls all the subroutines and, then, performs data communications with the second CPU 202 and the third CPU 203.

FIG. 9 shows the copying operation routine.

With the print key (71) on edge at Step S10, the sequence proceeds to Step S11 and if ADF (automatic document feeding unit) 300 is not in use, the print flag is made 1 in Step S12. If ADF is in use and when it is judged in Step S13 that a document is present on ADF tray 305, the ADF start signal is made 1 in Step S14. When the print key (71) is not on edge and ADF 300 is in use in Step S15, the sequence proceeds to Step S16 and if it is detected that the document-in-position signal (DIP) from ADF 300 is 1, the print flag is made 1 in Step S17.

Then, if it is detected that the print flag is 1 in Step S18 and the duplex copy preparation flag is 0 in Step S19, Steps S20 to S25 are executed. The above duplex copy preparation flag is a flag set in the duplex copying preparation subroutine in Step S5 and its details are described hereinafter with reference to FIG. 11. Thus, the flag is 1 after the duplex mode select switch 95 is pressed till completion of the movement of the dividing plates 593, 594 and 595 in the paper resupply tray 26.

In Step S20, a print flag S20 is set to 0 and the automatic paper select routine of Step S6 is called. This automatic paper select routine S6 will be described in detail hereinafter with reference to FIG. 10. Thus, it is a process for automatic selection and supply of copying paper of a size suitable for the document size.

In Step S21, it is judged if the size improper flag set in the above Step S6 when copying paper sized to suit the document size has not been loaded into the copying machine is 0 or not. If, in Step S21, the answer is YES, that is to say if copying paper of the proper size has been set, the copying start flag for initiating a copying operation is set to 1.

In Step S23, it is enquired if the display lamp 95a indicating selection of the double side copying mode is ON or not and in Step S24, it is enquired if a second copy flag indicating second-side copying is 0 or not. And if the duplex copying mode has been selected and the copying to be done is copying on the first side, the second copy flag indicative of copying on the first side is set to 1 in Step S25.

In Step S26 it is enquired if the second copy flag is 1 or not, and if it is 1, that means copying on the second side. The sequence advances to Step S27. In Steps S27 and S28, it is detected if the document at copying on the first side was A4 lateral or B5 longitudinal. And in Steps S29 and S30, it is detected if the document to be copied then is A3 or B4 and if so, it is judged that the document size is twice the size of copying paper. Then, in Steps S32 and S33, a divisional scan signal is made 1 and the first-half scan signal is made 1 for the divisional scanning mode.

On this divisional scanning mode, the first region of the document is copied on the reverse side of the copying paper for which copying on the face side has already been completed, and the remaining second region is copied on the face side of another copying paper that follows.

FIG. 9 (*c*), (*d*), (*e*) are flow charts showing the entire copying operation. In Block 10, when the copy start flag becomes 1, the main motor, development motor, charger, transfer charger and exposure lamp are turned ON, the start flag is set to 0, and T-A (Timer A) and T-B (Timer B) are set. In addition, if the first paper supply tray 24 has been set, the first paper supply roller clutch is turned ON or if the second paper supply tray 25 has been selected, the lower paper supply roller clutch is turned ON. If the second copy flag is 1, that means copying on the second side, the paper resupply roller clutch is turned ON. In Block 12, T-B is judged and if it is the time of completion of T-B, a scan signal is turned ON. In Block 13, as the timing signal becomes 1, the timing roller CL is turned ON and the T-C is set. In Block 14, the charger, scan signal, timing roller CL and exposure lamp are turned off at completion of T-C. In Block 15, when the return signal is 1, that is as the return motion is initiated, it is judged if it is multiple copying or a copying operation has been completed and if it has not been completed, the copy start flag is made 1. When the first copy flag is 1, the first copy flag is made 0 and the second copy flag is made 1.

When the divisional scan signal is 1, it means the end of the divisional scan mode and, therefore, the divisional scan signal is made 0 and the second regional scan signal is also made 0.

On the other hand, when the first copy flag is 0, when the scanner away from a predetermined position has come back to turn the position switch, the development motor and transfer charger are made 0, the second copy flag is made 0, and T-D is set.

Then, it is enquired if the divisional scan signal is 1 or not. If the signal is 1, it means that the first regional copying has been completed. Therefore, the first regional scan signal is made 0 and the second regional scan signal is made 1. However, with the above actions only, the third CPU 203 would change the document. Therefore, the signal indicating that scannings corresponding to the number of copies have been done is stopped and for copying of the second region of the document, the document position signal is fictitiously made 1. In Block 16, the main motor is turned OFF at completion of T-D. In Block 17, results of the operations so far performed are outputted.

Figure 10:
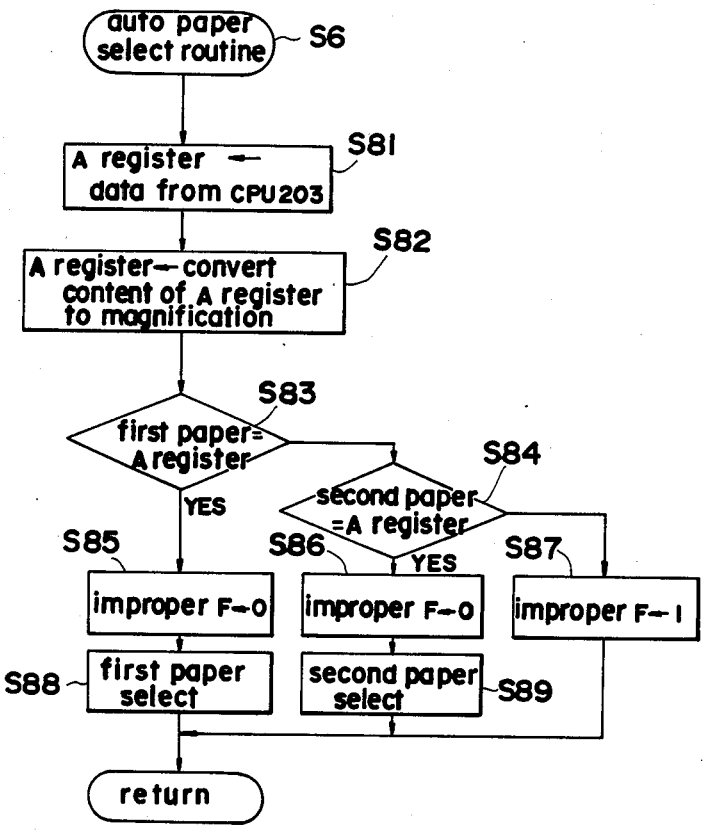

FIG. 10 shows the automatic paper select routine.

In Step S82, the data on document size detected and transmitted by the third CPU 203 is factorially converted to an image size data with the magnification factor inputted by a magnification factor inputting means not shown and stored temporarily in A Register in the third CPU 203. In Step S83, the paper size in the first paper supply tray 24 of the copying machine body is compared with A Register. In Step S85, if the data are equal, the size improper flag is made 0 and the first paper supply tray is selected. Then, in Step S84, the paper size in the second paper supply tray 25 is similarly compared with A Register. If neither the paper size in the first paper supply tray nor that in the second paper supply tray is equal to A Register, the size improper flag is made 1 in Step S85.

Figure 11:
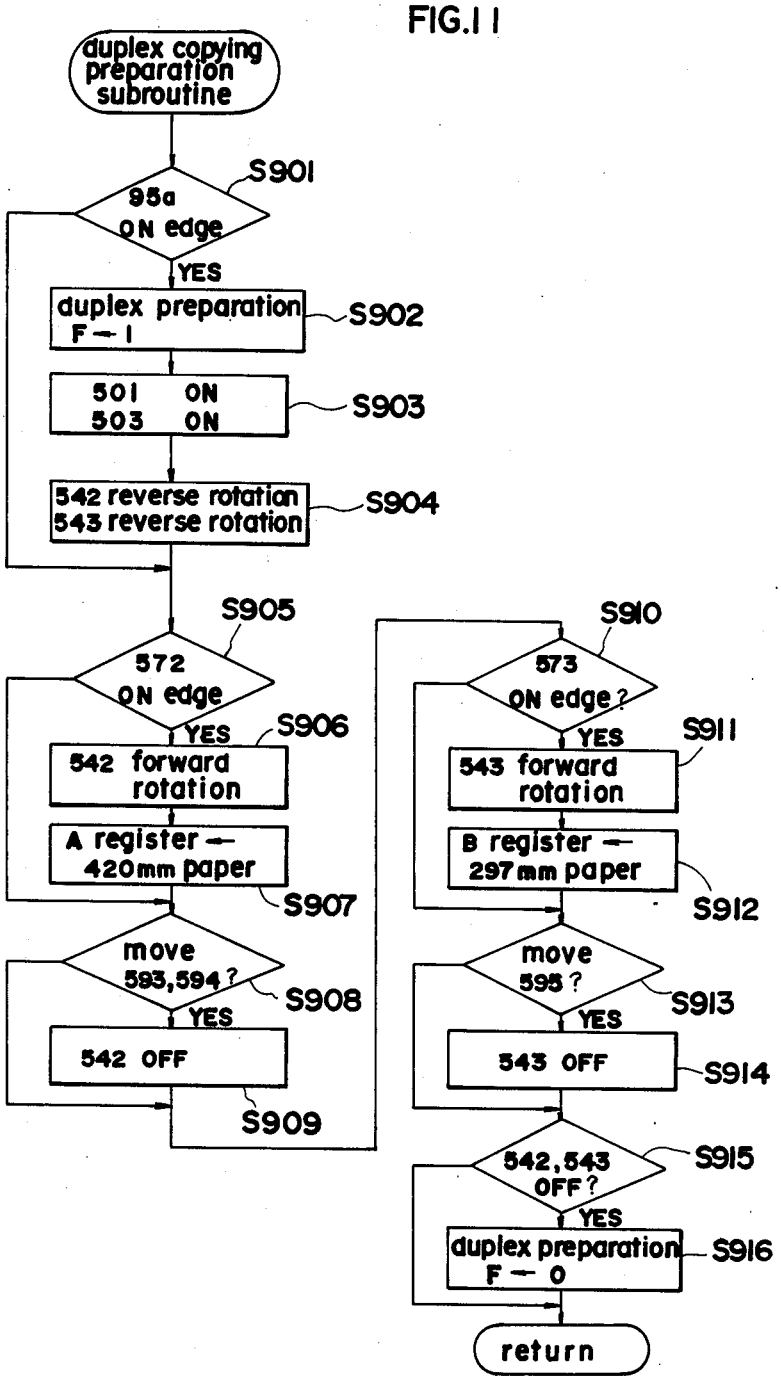

FIG. 11 shows the duplex copying preparation routine.

In Step S901, it is enquired if the indicating lamp 95a is on edge and if the on edge, i.e. duplex copying, is selected, the duplex preparation flag is made 1 in Step S902. In Step 903, the discharge switching solenoid 501 is turned ON so that the copying paper for which face side copying has been completed will be sent into the paper resupply tray (26). And the paper resupply roller up and down solenoid (503) is made ON so as to make the paper resupply roll ascend out of the way.

Then, in Step S904, the stepping motors (542) and (543) are respectively reversed. Thus, in order to shift the dividing plates (593), (594) and (595) to the respective reference positions, the dividing plates (593) and (594) are shifted toward a limiter switch (572) and the dividing plate (595) toward a limiter switch (573).

Then, as it is detected in Step S905 that the limiter switch (572) has been turned ON, the rotational direction of the stepping motor 542 is changed to "normal" in Step S906. In Step S907, a paper length value of 420 mm(maximum length) is memorized in A Register, and in Step S910, it is judged that the dividing plates (593), (594) have been shifted by the equivalent of A Register data and in Step S909 the stepping motor (542) is turned OFF. The same is true of the width value. Thus, as it is detected in Step S910 that the limiter switch (593) has been turned ON, the rotation of the stepping motor (543) is changed to "normal" and in Step S912 the paper width value of 297 mm (Maximum width) is memorized in B Register. Then, as the dividing plate (595) has been shifted by the equivalent of B Register data, the stepping motor (543) is turned OFF (Step S914). When both stepping motors 542 and 543 have been turned OFF, the duplex copying preparation flag is made 0 in Step S916. The above operations complete a preparation for receipt of the copying paper for which a first-side copying has been done.

Figure 12:
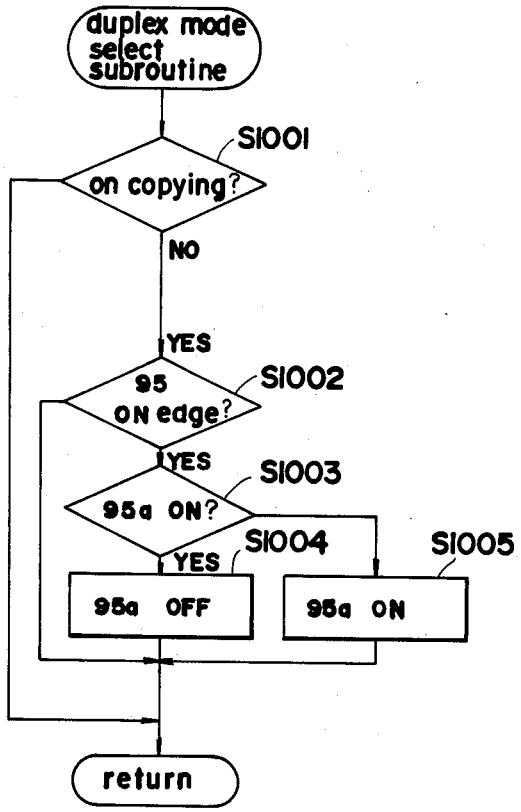

FIG. 12 shows the duplex mode select subroutine.

When it is detected in Step S1001 that copying is not being done and it is detected in Step S1002 that the duplex copying select key 95 is on edge, the indicating lamp 95a, if it is ON in Step S1003, is turned OFF in Step S1004 and if it is OFF is turned ON in Step S1005.

Figure 13:
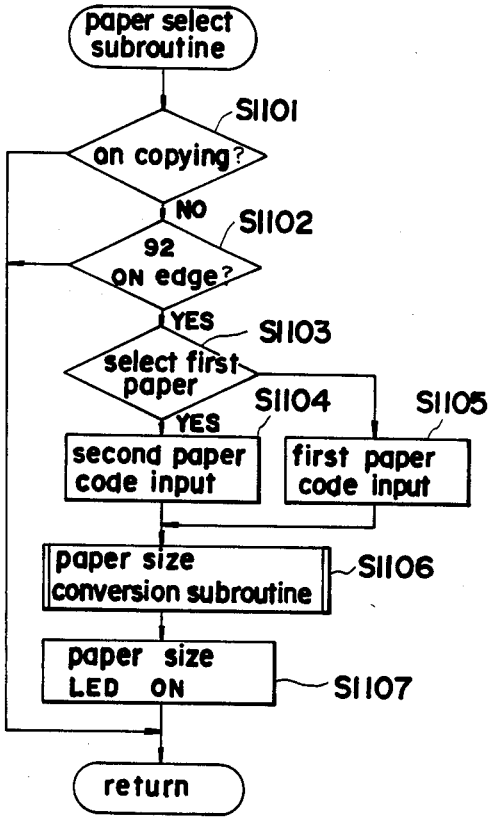

FIG. 13 shows the paper select routine.

If it is judged in Step S1101 that copying is not being done and when it is sensed in Step S1102 that the paper select switch (92) is ON, the second paper supply tray 25 is selected if the current selection is the first paper supply tray 24 while the first paper supply tray 24 is selected if the current selection is the second paper supply tray 25, and the particular paper size code is entered. In Step S1106, the paper size code conversion routine is called and one of the LEDS 92*a* to 92*d* that corresponds to the set paper size is turned ON (Step S1107).

Figure 14:
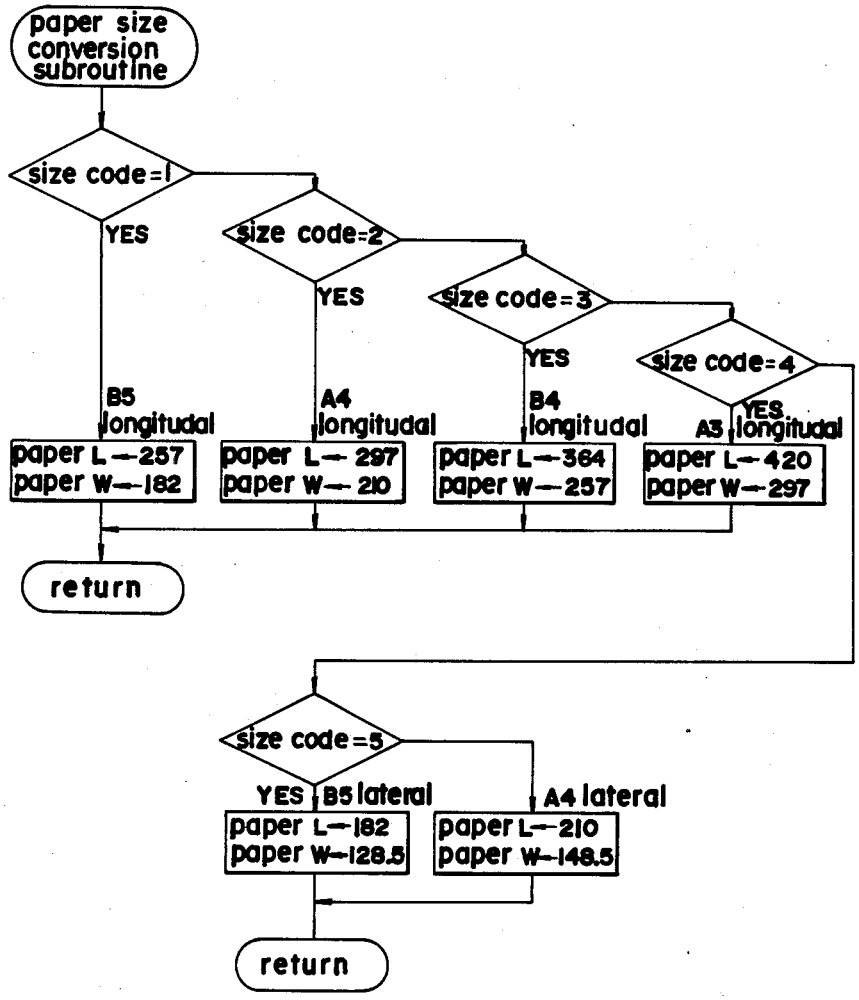

The paper size conversion routine is shown in FIG. 14.

If the inputted size code is 1, it means that the size is B5 longitudinal and the paper length of 257 mm and the paper width of 182 mm are memorized.

The size codes of 2, 3 and 4 mean the A4 longitudinal, B4 logitudinal and A3 logitudinal, respectively, and therefore the paper length of 297 mm and width of 210 mm, the paper length of 364 mm and width of 257 mm, and the paper length of 420 mm and width of 297 mm respectively are memorized.

The size codes of 5 and 6 mean B5 lateral and A4 lateral, respectively, and therefore, the paper length of 182 mm and width of 128.5 mm and the paper length of 210 mm and width of 148.5 mm respectively are memorized.

Figure 15:
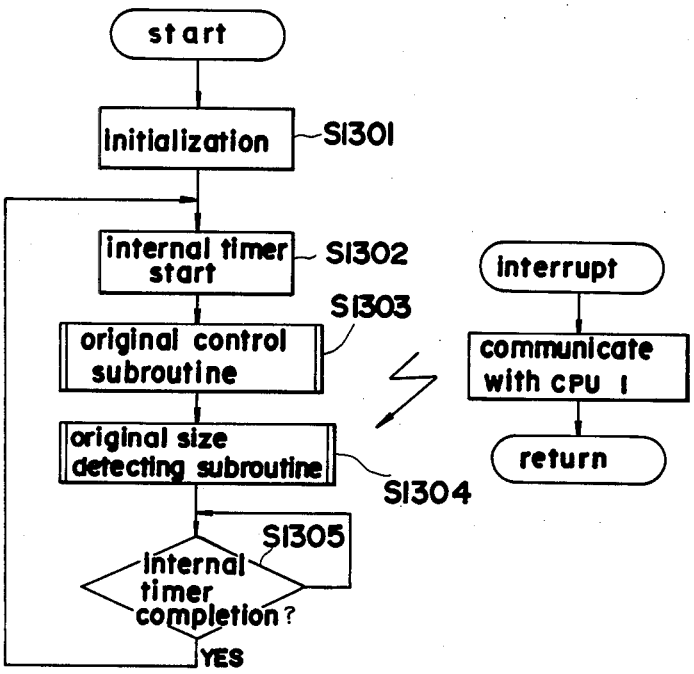

FIG. 15 shows a schematic flow chart of the third CPU 203.

When the third CPU 203 has been reset and the program is started, clearing of RAM, initializing of the CPU with regard to various register settings, and initial setting of the machine for the initial mode are performed (Step S1301).

Now, in Step S1302, the internal timer built into the third CPU 203 with its value preset by initial setting is started.

Then, the subroutines S1303 and S1304 shown in the flow chart are sequentially called and when all the subroutine operations have been completed, counting-up of the internal timer first set in Step S 1305 is awaited to complete one routine. Using the length of time of this one routine, the various timers in the subroutines are counted. The counting-up of each timer is judged from how many times the above one routine was counted. The data communication with the first CPU 201 is performed by the interruption routine upon an interrupt request from the first CPU 201 irrespective of the main routine.

Figure 16:
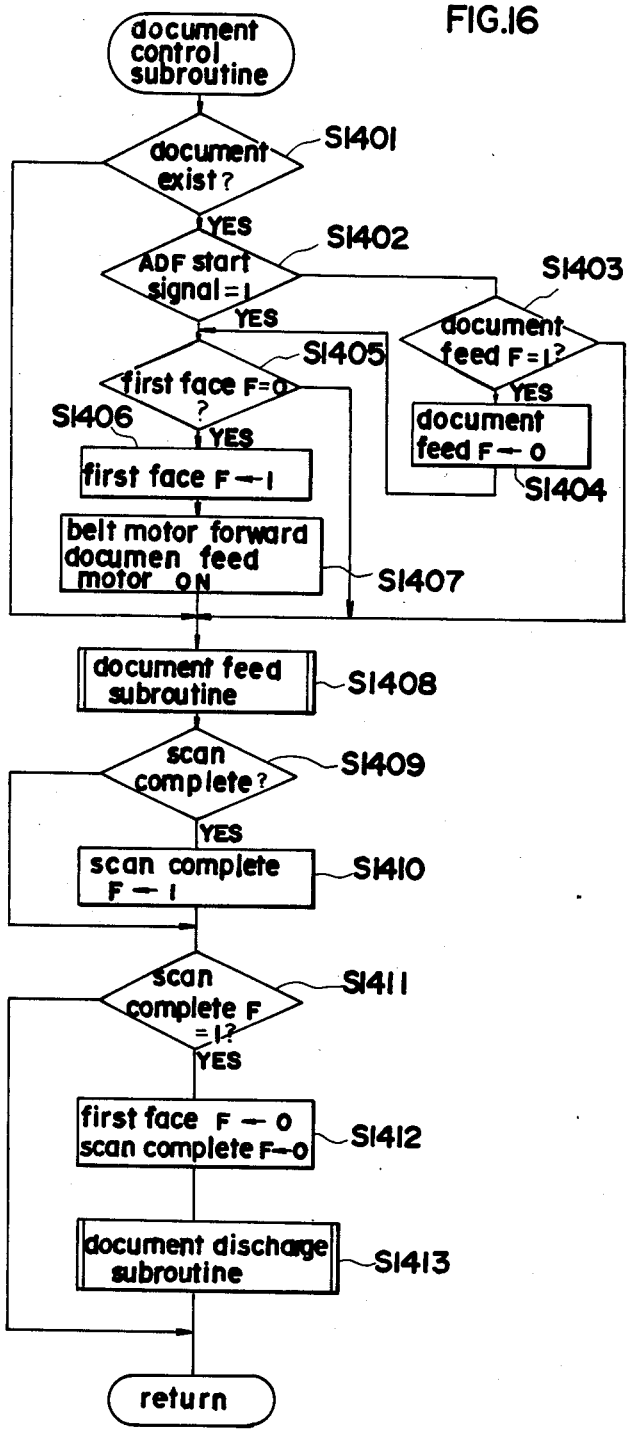

FIG. 16 shows the document control routine.

In Steps S1401, whether a document is present on the document tray (305) is judged from the ON-OFF state of the sensor (311) and if the sensor is ON, it is enquired in Step S1403 if the ADF start signal from the first CPU 201 is 1 or not. In Step S1403, it is enquired whether the document supply flag is 1 or not and if it is 1, the document supply flag is made 0 in Step S1401 and the sequence advances to Step S1405. If it is judged in Step S1405 that the face flag is 0, that means the face-side copying mode, the face flag 1 is made 1 in Step S1406. Then, in Step S1407, the conveyor belt motor is turned ON and the document supply motor is turned ON. In Step S1408, the document supply routine is executed. In Step S1409, it is judged if the scannings corresponding to the set number of copies have been completed and if the judgement is YES, the scan end flag is made 1 in Step S1410 and the sequence proceeds to Step S1411. When the scannings corresponding to the set number of copies have not been completed, the sequence proceeds to Step S 1411 as well. It is enquired in Step S1411 if the scan end flag is 1, and if the flag is 1, the sequence proceeds to Step S 1412 where the face flag is set to 0 and the scan end flag set to 0. Then, the document discharge routine in Step S1413 is executed.

FIG. 17 shows a flow chart showing the sequence of operations in the second CPU 202.

In Step S111, it is enquired if the scan signal is on edge and if the answer is YES, scanning by the optical system 10 is initiated in Step S112. The sequence then proceeds to Step S113. If the answer is NO, the sequence proceeds directly to Step S113.

In Step S113, it is enquired whether the divisional scan signal is 1 or not and if it is "1", the sequence proceeds to Step S114. In Step S114, it is enquired if the first regional scan signal is "1". If it is "1", the sequence proceeds to Step S115. In Step S115, it is enquired if the first regional scan has been completed and if it has been completed, the sequence proceeds to Step S116. In Step Sl16, the return signal is made "1" and the sequence advances to Step S117. If it is judged in Step S113 that the divisional scan signal is not "1", the sequence proceeds to Step S118, where it is enquired if scanning over the range calculated from the length of copying paper and copy magnification factor has been completed or not and if the answer is YES, the sequence proceeds to Step S116. If the answer is NO, the sequence proceeds directly to Step S117.

If it is judged in Step S114 that the first regional scan signal is not "1", the sequence proceeds to Step S119 where it is enquired if the second regional scanning has been completed. If the answer is YES, the sequence proceeds to Step Sl16 and if the answer is NO, the sequence proceeds directly to Step Sl17.

In Step S117, it is enquired if the divisional scan signal is "1" and if it is "1", it is enquired in Step S120 if the first regional scan signal is "1". If the answer is YES, the sequence proceeds to Step S121, while if the answer is NO, the sequence advances to step S125. When it is judged in Step Sl17 that the divisional scan signal is not "1", the sequence proceeds directly to Step S121.

Step S121 through Step S124 correspond to the operations for outputting the timing signals for first-regional copying on the divisional scan mode and copying on the regular mode. In Step S121, it is enquired if the optical system has turned on a timing switch SW51 and if the answer is YES, the timer T-F is set in Step S122. In Step S123, it is enquired if the timer T-F has been counted up and if the answer is YES, a timing signal "1" is outputted in Step S124.

Step S125 through Step S128 correspond to the operations for outputting the timing signals for second-regional copying on the divisional scan mode. In Step S125, it is enquired if the optical system 10 has passed the end-point of first-regional scanning and if the answer is YES, the timer T-G is set in Step 126. In Step S127, it is enquired if the timer T-G has been counted up and if the answer is YES, the timing signal "1" is outputted in Step S128. It should be understood that the operation times of said timers T-F and T-G are varied according to the magnification factor. In Step S129, it is enquired if the position switch SW50 adapted to turn on when the optical system returns to a predetermined position is on edge, and if the answer is YES, the sequence proceeds to step S130, where the return of the optical system 10 is stopped and the return signal is made "0", the position signal "1", and the timing signal "0". On the other hand, if the answer is NO in Step S129, the position signal is made "0" in Step S131.

Figure 18:
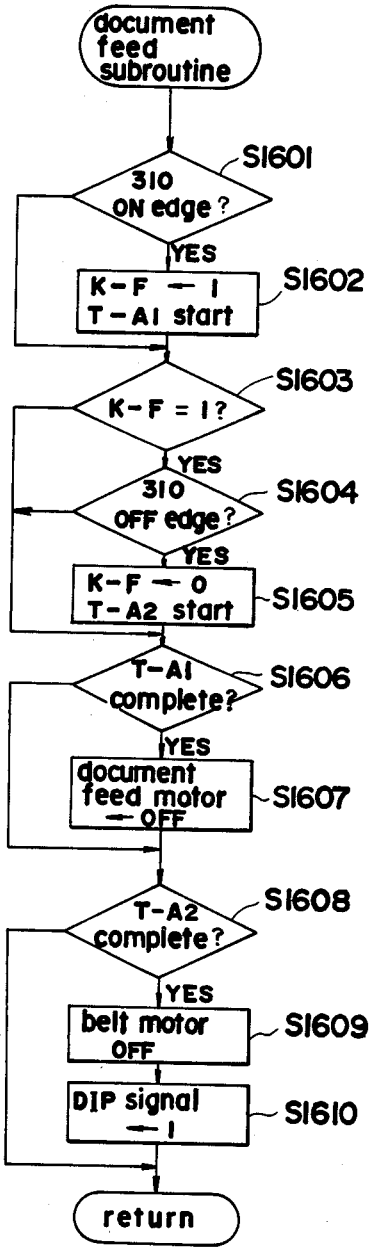

FIG. 18 shows the document supply routine.

If the document detection sensor (310) is found to be on edge in Step S1601, the document has been supplied and the sensor (310) is ON, the flag K is made 1 in Step S1601 and a timer A1 is started. This timer A1 is adapted to switch off the document supply motor and has been set to a time period till the document comes to a position where it is driven by the conveyor belt. If the motor was kept turning, the next document would be fed after completion of the first document. The timer A1 is designed to prevent this from happening.

Then, in Step S1603, it is enquired if the flag K is 1. If the flag K is 1, it is enquired in Step S1604 if the sensor (310) is off edge. If the sensor (310) is found to be off edge and the trailing end of the document is detected, the flag K is made 0 and the timer A2 is started in Step S1605. The timer A2 is set to a value till the trailing end of the document reaches the document leading-end point of the glass document table. In Step S1606, it is enquired if the time set in timer A1 has run out. If the answer is YES, the document supply motor is switched off in Step S1607. In Step S1608, it is enquired if the time set in timer A2 has run out. If the answer is YES, the conveyor belt motor is switched OFF in Step S 1609 and a document position signal is transmitted to the first CPU 201 in Step S1610.

Figure 19:
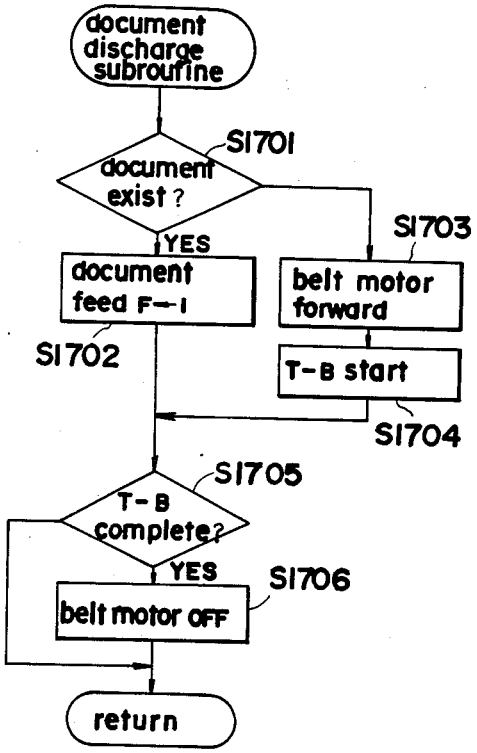

FIG. 19 shows the document discharge routine.

In Step S1701, it is enquired if a document is present on the document tray (305) and if the next document still exists on the document tray, the document supply flag is made 1 in step S1702. If there is no document, the sequence proceeds to Step S1703 where the conveyor belt motor is driven in normal direction. In Step S1704, the timer B is started. The timer B has been set to a time required for discharging the largest document on the glass document table. In Step S1706, it is enquired if the timer B has counted up and if the answer is YES, the conveyor belt motor is switched OFF in Step S1706.

Figure 20:
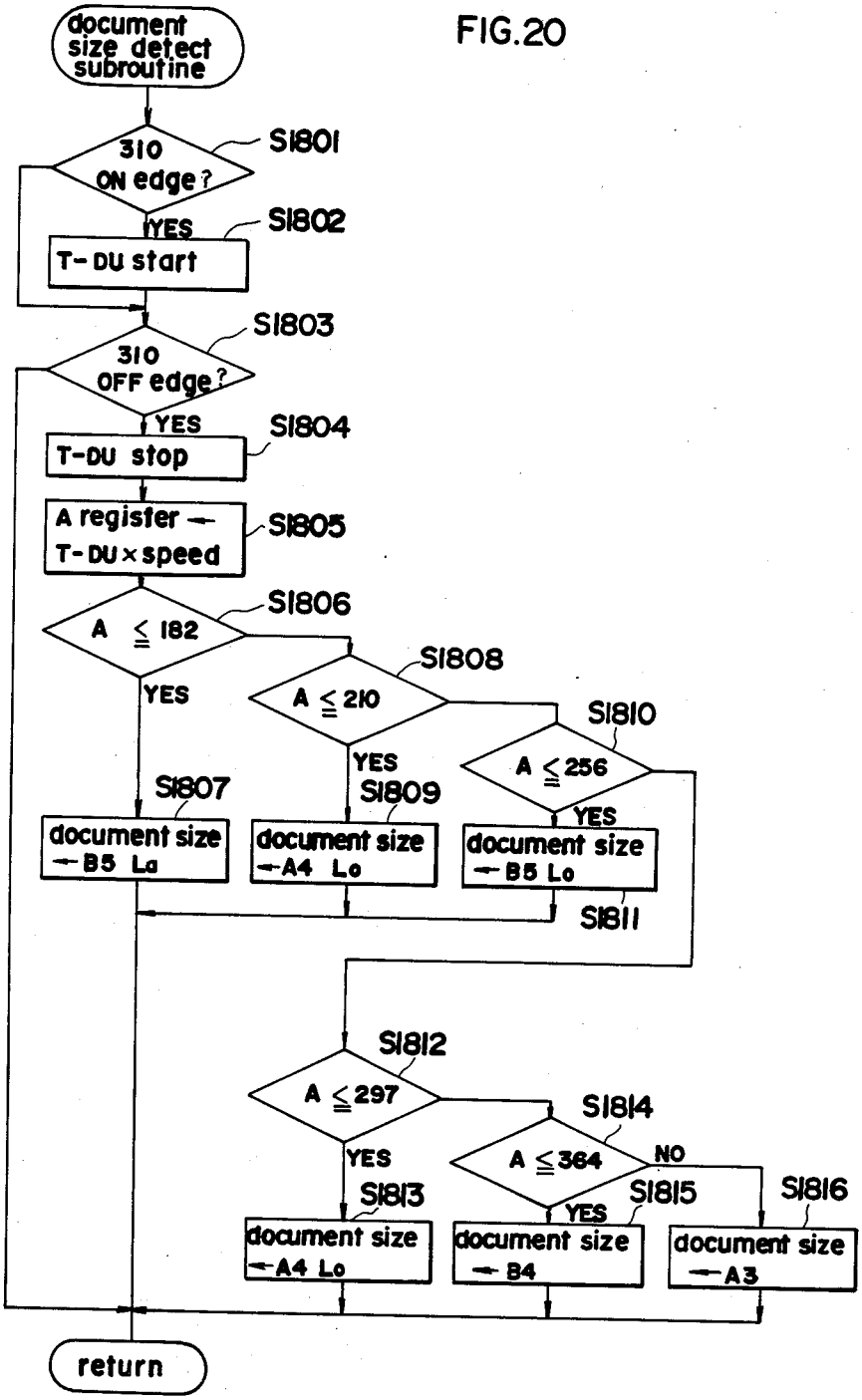

FIG. 20 shows the document size detection routine.

In Step S1801, it is enquired if the document detection sensor (310) is on edge and if it is on edge, the sequence proceeds to Step S 1802 where the timer DU is started.

Then, in Step S1803, it is enquired if the document detection sensor (310) is off edge and if it is off edge, which signifies the passage of the trailing end of the document, the timer DU is stopped in Step S1804. In Step S1805, the value arrived at by multiplying the current timer DU value by the document transport speed, that is the length of the document, is stored in A Register. Based on the value in A Register, the document size is judged in Steps S1806 to S1816. For example, if it is judged in Step S1806 that the content of A Register is $\leqq 182$, B5 lateral is selected as the document size. The same applies to the other steps.

While in the above embodiment the document size and the copying paper size were automatically sensed by respective sensors and the discharge of copying paper and the two side copying mode were instructed, the document size and copying paper size instructions may be made by means of key switches or the like instead of sensors.

Furthermore, while the above embodiment is a copying machine that executes divisional copying when the document size for face side copying differs from that for reverse side copying, the present invention can be applied not only to duplex copying but also to simplex copying. For example, when a plurality of A4 documents and A3 documents are mixedly set on the document tray (305) of ADF (300) and copying is performed on A4 copying paper, it is possible to execute ordinary full-size copying for A4 documents and divisional copying for A3 documents.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus comprising:
means for designating the size of an original document to be copied;
means for copying the image of said original document onto a surface of a recording medium;
means for memorizing the size of the document just copied; and,
means for controlling said copying means to copy halves of the next original document respectively on different recording surfaces when the size of the next original document to be copied is twice the size of the document previously copied.

2. A copying apparatus as claimed in claim 1, wherein said control means controls said copying means when the designated size to be copied is two times as large as that of the previously copied image.

3. A copying apparatus as claimed in claim 1, wherein said original size designating means comprises a size detecting sensor for detecting the size of the original to be copied.

4. A copying apparatus as claimed in claim 3, further comprising means for feeding originals to be copied one by one from an original accommodating position to an exposure position.

5. A copying apparatus as claimed in claim 4, wherein said detecting sensor is provided at an original feed path between the original accommodating position and the exposure position.

6. A copying apparatus comprising:
means for designating the size of an original document to be copied;
means for copying the original document in a first mode in which substantially all the area of the original document is copied on a single surface of a recording medium;
means for copying the original document in a second mode in which halves of the original document are respectively copied on different surfaces of the recording medium;
first control means for executing the first copy mode based on the designated size; and,
second control means for executing the second copy mode based on the designated size when the designated size to be copied is a predetermined size which is different from that previously copied.

7. A copying apparatus as claimed in claim 6, wherein said original size designating means comprises a size detecting sensor for detecting the size of the original to be copied.

8. A copying apparatus as claimed in claim 7, further comprising means for feeding originals to be copied one by one from an original accommodating position to an exposure position.

9. A copying apparatus as claimed in claim 8, wherein said detecting sensor is provided at an original feed path between the original accommodating position and the exposure position.

10. A copying apparatus as claimed in claim 6, further comprising means for manually selecting one of said first mode and said second mode.

11. A copying apparatus as claimed in claim 10, wherein said second control means executes the second copy mode regardless of mode selection by said manual selecting means.

12. A copying apparatus as claimed in claim 11, wherein said second control means executes the second copy mode when the designated size to be copied is two times as large as that of a previously copied image.

13. A duplex copying apparatus comprising:

means for designating the size of an original document to be copied;

means for copying the original document in a first mode in which substantially all the area of the original document is copied on a single surface of a recording medium;

means for copying the original document in a second mode in which halves of the original document are respectively copied on different surfaces of the recording medium;

first copy control means for copying the original document in the first mode onto a first surface of the recording medium based on the designated size; and, second copy control means for copying the original document in the second mode when the size of the document to be copied on a second surface of the recording medium is in a predetermined relation with the size of the document copied on the first face.

14. A duplex copying apparatus as claimed in claim 13, wherein half of the area of the original document is copied on the second surface of the copy paper and the other half of the area of the original document is copied on the first surface of a next copy paper.

15. A duplex copying apparatus as claimed in claim 14, wherein said second control means executes the second copy mode when the designated size to be copied is two times as large as that of a previously copied image.

16. A duplex copying apparatus as claimed in claim 13, wherein said original size designating means comprises a size detecting sensor for detecting the size of an original to be copied.

17. A duplex copying apparatus as claimed in claim 16, further comprising means for feeding originals to be copied one by one from an original accommodating position to an exposure position.

18. A duplex copying apparatus as claimed in claim 17, wherein said detecting sensor is provided at an original feed path between the original accommodating position and the exposure position.

19. A duplex copying apparatus comprising:

means for designating a size of an original document to be copied;

means for memorizing a size of a first original document to be copied on a first surface of a recording medium;

means for copying the first original onto the first surface of the recording medium;

means for copying a part of a second original document onto a second surface of the recording medium and copying another part of the second original document onto a first surface of the next recording medium when the size of the original document to be copied on the second surface is larger than the size of the first original document.

20. A duplex copying apparatus for forming the image of an original document onto a first side and a second side of a recording sheet comprising:

means for detecting the size of the original document to be copied;

means for copying the original document in a first copy mode;

means for copying the original document in a second copy mode; and means for selecting the second copy mode automatically when the size of the original document to be copied onto the second side of the recording sheet is in a predetermined relation with the size of the original document copied on the first side of the recording sheet in the first copy mode.

21. A duplex copying apparatus as claimed in claim 20, further comprising means for feeding originals to be copied one by one from an original accommodating position to an exposure position.

22. A duplex copying apparatus as claimed in claim 21, wherein said detecting means is provided at an original feed path between the original accommodating position and the exposure position.

23. A copying apparatus comprising:

means for mounting original documents which is capable of mounting different size original documents at a time;

means for detecting the size of an original document to be copied;

means for copying the image of said original document onto a surface of recording medium in a first mode or a second mode, said first mode being different from said second mode; and means for selecting said first mode and second mode in accordance with the detected size.

24. A copying apparatus comprising:

means for detecting the size of original documents to be copied;

first means for copying the original document in a first mode in which substantially all the area of the original document is copied on a single surface of a recording medium;

second means for copying the original document in a second mode in which halves of the original document are respectively copied on different surfaces of the recording medium; and means for selecting one of said first and second modes in accordance with the detected size.

25. A copying apparatus comprising:

means for accommodating original documents to be copied means for feeding the original documents one by one from said accommodating means onto a platen glass;

means for detecting the size of the original document to be copied;

first means for copying the original document in a first mode in which substantially all the area of the original document is copied on a single surface of the recording medium;

second means for copying the original document in a second mode in which halves of the original document are respectively copied on different surfaces of the recording medium; and means for selecting one of said first and second modes in accordance with the detected size.

26. A copying apparatus as claimed in claim 25, wherein said accommodating means is capable of accommodating different size documents at one time.

* * * * *